US010663179B2

(12) United States Patent
Suzuki

(10) Patent No.: US 10,663,179 B2
(45) Date of Patent: May 26, 2020

(54) HEAT PUMP APPARATUS

(71) Applicant: Mitsubishi Electric Corporation, Tokyo (JP)

(72) Inventor: Yasuhiro Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 331 days.

(21) Appl. No.: 15/307,846

(22) PCT Filed: Mar. 13, 2015

(86) PCT No.: PCT/JP2015/057433
§ 371 (c)(1),
(2) Date: Oct. 31, 2016

(87) PCT Pub. No.: WO2015/190144
PCT Pub. Date: Dec. 17, 2015

(65) Prior Publication Data

US 2017/0059185 A1 Mar. 2, 2017

(30) Foreign Application Priority Data

Jun. 13, 2014 (JP) ..... 2014-122753

(51) Int. Cl.
*F24F 1/0007* (2019.01)
*F24D 15/04* (2006.01)
(Continued)

(52) U.S. Cl.
CPC ..... *F24D 15/04* (2013.01); *F24F 1/0007* (2013.01); *F25B 30/02* (2013.01); *F25B 47/025* (2013.01);
(Continued)

(58) Field of Classification Search
CPC ..... F25B 25/005; F24F 2001/004; F24F 2001/0037; F24F 1/0073; F24F 1/007; F24F 1/0007
See application file for complete search history.

(56) References Cited

U.S. PATENT DOCUMENTS 5,634,346 A * 6/1997 Ramakrishnan ... G05D 23/1904 62/89
6,295,823 B1 * 10/2001 Odom ..... F24F 1/0007 165/139
(Continued)

FOREIGN PATENT DOCUMENTS

CN 103221751 A 7/2013
CN 204718181 U 10/2015
(Continued)

OTHER PUBLICATIONS

English Translation JP2002195642 (Year: 2002).*
(Continued)

*Primary Examiner* — David J Teitelbaum
(74) *Attorney, Agent, or Firm* — Posz Law Group, PLC

(57) ABSTRACT

A heat pump apparatus includes a refrigerant circuit for circulating combustible refrigerant, and a load unit to be provided in a room and configured to accommodate a load side heat exchanger. The load side heat exchanger allows heat exchange between the combustible refrigerant and a liquid heat medium. The load unit includes a fan, an air inlet for sucking in air from the room, and an air outlet for blowing out the air, sucked in from the air inlet, to the room. The air outlet is provided at a position of a height different from the height of the air inlet.

5 Claims, 6 Drawing Sheets

(51) Int. Cl.

| | |
|---|---|
| ***F25B 47/02*** | (2006.01) |
| ***F25B 30/02*** | (2006.01) |
| *F24F 11/36* | (2018.01) |

(52) U.S. Cl.

CPC ..... *F24F 11/36* (2018.01); *F24F 2221/183* (2013.01); *F25B 2339/047* (2013.01); *F25B 2400/12* (2013.01); *F25B 2500/22* (2013.01)

(56) References Cited

U.S. PATENT DOCUMENTS

| | | | | |
|---|---|---|---|---|
| 7,334,424 | B2 * | 2/2008 | Park | F24F 1/0007 62/428 |
| 2010/0168921 | A1 * | 7/2010 | Park | F24F 1/0011 700/276 |
| 2013/0174592 | A1 | 7/2013 | Yamashita et al. | |
| 2013/0192283 | A1 | 8/2013 | Yamashita et al. | |
| 2014/0196483 | A1 * | 7/2014 | Okazaki | F25B 49/02 62/79 |
| 2017/0059185 | A1 | 3/2017 | Suzuki | |

FOREIGN PATENT DOCUMENTS

| | | | | | |
|---|---|---|---|---|---|
| EP | 2541169 | A1 | | 1/2013 | |
| EP | 2 589 900 | A1 | | 5/2013 | |
| JP | 11-037619 | A | | 2/1999 | |
| JP | 2002195642 | A | * | 7/2002 | F24F 1/0014 |
| JP | 2005-016874 | A | | 1/2005 | |
| JP | 2006-138582 | A | | 6/2006 | |
| JP | 2007-120772 | A | | 5/2007 | |
| JP | 2007-309566 | A | | 11/2007 | |
| JP | 2010-144965 | A | | 7/2010 | |
| JP | 4639451 | B | | 2/2011 | |
| JP | 2011-075178 | A | | 4/2011 | |
| WO | 2011/104870 | A1 | | 9/2011 | |
| WO | 2012/073293 | A1 | | 6/2012 | |
| WO | 2013/038599 | A1 | | 3/2013 | |
| WO | 2013/038704 | A1 | | 3/2013 | |

OTHER PUBLICATIONS

Extended European Search Report dated Jan. 23, 2018 issued in corresponding EP patent application No. 15805751.3.

Office Action dated Jun. 15, 2017 issued in corresponding CN Patent Application No. 201510289151.8 (and English translation).

Office Action dated Dec. 6, 2017 issued in corresponding CN Patent Application No. 201510289151.8 (and English translation).

Office Action dated Sep. 20, 2016 in the corresponding JP Patent Application No. 2014-122753 (and English translation).

International Search Report of the International Searching Authority dated May 19, 2015 for the corresponding International application No. PCT/JP2015/057433 (and English translation).

Office Action dated Mar. 14, 2017 issued in the corresponding JP Patent Application No. 2014-122753 (and English translation).

Office Action dated May 8, 2018 issued in corresponding CN patent application No. 201510289151.8 (and English translation thereof).

* cited by examiner

HEAT PUMP APPARATUS

CROSS REFERENCE TO RELATED APPLICATIONS

This application is a U.S. national stage of International Application No. PCT/JP2015/057433 filed on Mar. 13, 2015, and is based on Japanese Patent Application No. 2014-122753 filed on Jun. 13, 2014, the disclosures of which are incorporated herein by reference.

TECHNICAL FIELD

The present invention relates to a heat pump apparatus.

BACKGROUND ART

Conventionally, incombustible HFC refrigerant such as R410A has been used in a heat pump apparatus. As R410A has zero ozone depletion potential (hereinafter referred to as "ODP"), which is different from conventional HCFC refrigerant such as R22, there is no risk of disrupting the ozone layer. However, R410A has a characteristic of high global warming potential (hereinafter referred to as "GWP"). As such, as part of prevention of global warming, a shift from HFC refrigerant having high GWP, such as R410A, to refrigerant having low GWP is being considered.

Refrigerant candidates of such low GWP include HC refrigerant such as R290 ($C_3H_8$; propane) and R1270 ($C_3H_6$; propylene) that are natural refrigerants. However, R290 and R1270 have high-level combustibility (high combustibility), which is different from incombustible R410A. As such, it is necessary to pay attention to leakage of refrigerant when using R290 or R1270 as refrigerant.

Further, refrigerant candidates of low GWP also include HFC refrigerant having no carbon double bonds in its composition such as R32 ($CH_2F_2$; difluoromethane) having lower GWP than that of R410A.

Further, as a similar refrigerant candidate, there is halogenated hydrocarbon that is a kind of HFC refrigerant, similar to R32, and has carbon double bonds in its composition. Such halogenated hydrocarbon includes HFO-1234yf ($CF_3CF{=}CH_2$; tetrafluoropropene) and HFO-1234ze ($CF_3{-}CH{=}CHF$), for example. It should be noted that HFC refrigerant having carbon double bonds in its composition is likely to be expressed as "HFO" by using "O" standing for olefin (unsaturated hydrocarbon having carbon double bonds is called olefin), to be distinguished from HFC refrigerant having no carbon double bonds in its composition such as R32.

Such low-GWP HFC refrigerant (including HFO refrigerant) has slight-level combustibility (slight combustibility) that is different from incombustible R410A, although it is not highly combustible like HC refrigerant such as R290 that is natural refrigerant. As such, similarly to the case of R290, it is necessary to pay attention to leakage of refrigerant. Hereinafter, refrigerant having combustibility of a slight combustible level or higher (for example, 2L or higher in ASHRAE34 classification) is referred to as "combustible refrigerant".

If combustible refrigerant is leaked into the room, the refrigerant concentration in the room may increase to form a combustible concentration region.

Patent Literature 1 describes an air-conditioning apparatus using combustible refrigerant, in which a gas sensor for detecting combustible refrigerant gas is provided on the outer surface of a floor type indoor unit, and the gas sensor is provided on the lower part of the indoor unit. When a sensor detection voltage by the gas sensor is a reference value or higher, the controller of the air-conditioning apparatus determines that combustible refrigerant is leaked, and gives warning immediately by an alarm. Thereby, a user is able to know leakage of combustible refrigerant, so that the user is able to take measures such as ventilating the room or calling a serviceman for repair. Further, when the controller determines that combustible refrigerant is leaked, the controller immediately performs control to stop operation of the refrigerant circuit. Thereby, even if the air-conditioning apparatus is in operation, the refrigerant circuit can be blocked immediately by the valve provided on the refrigerant circuit, whereby it is possible to suppress a large amount of leakage of the combustible refrigerant.

Meanwhile, Patent Literature 2 describes an air-conditioning apparatus including an outdoor unit, a heat medium relay unit, and an indoor unit. In the air-conditioning apparatus, the heat medium relay unit is provided in a space different from the inside of a room although it is in the building, such as a space above the ceiling. The heat medium relay unit is equipped with a relay unit fan for ventilation inside the casing. Further, the casing of the heat medium relay unit has an opening port formed at a position where the air of the relay unit fan passes through. The relay unit fan is always made driven with ventilation air amount or more (including the time when operation of the air-conditioning apparatus is stopped), for example, to suppress the refrigerant concentration inside the casing of the heat medium relay unit to be less than a lower limit combustion concentration (hereinafter referred to as "LFL").

CITATION LIST

Patent Literature

Patent Literature 1: Japanese Patent No. 4639451

Patent Literature 2: International Publication No. 2012/073293

SUMMARY OF INVENTION

Technical Problem

However, in the air-conditioning apparatus described in Patent Literature 1, a gas sensor (refrigerant leakage sensor) for detecting combustible refrigerant gas is required. The lifetime (accuracy sustaining period) of such a refrigerant leakage sensor is usually one to two years, which is shorter than about ten years of the lifetime (standard use period) of the air-conditioning apparatus. As such, it is necessary to change the refrigerant leakage sensor many times during the use period of the air-conditioning apparatus. Further, there is a case where it cannot be replaced before the end of the lifetime of the refrigerant leakage sensor. This causes a problem that credibility thereof is not high enough. Further, while a user who is informed of leakage of combustible refrigerant by warning is able to take a measure by ventilating the room or calling a serviceman for maintenance, there is a problem that until the time when such a measure is taken, the leaked combustible refrigerant may form a combustible concentration region in the room that is usually a closed space. Further, although it is possible to suppress a large amount of leakage of combustible refrigerant because the controller immediately performs control to stop operation of the refrigerant circuit upon determination of combustible refrigerant being leaked, it is impossible to prevent a certain amount of leakage of combustible refrigerant. As such, there is a problem that leaked combustible refrigerant may form a combustible concentration region in the room that is usually a closed space.

Further, in the air-conditioning apparatus described in Patent Literature 2, although the refrigerant concentration in the casing of the heat medium relay unit is suppressed to a level less than LFL, the refrigerant discharged from the casing of the heat medium relay unit is not always diffused effectively outside the casing. As such, there is a problem that the refrigerant discharged from the casing may form a combustible concentration region in a space inside the building.

The present invention has been made to solve at least one of the problems described above. An object of the present invention is to provide a heat pump apparatus capable of suppressing formation of a combustible concentration region in a room even if combustible refrigerant is leaked.

Solution to Problem

A heat pump apparatus according to an embodiment of the present invention includes a refrigeration cycle configured to circulate combustible refrigerant; and a load unit disposed in a room, the load unit being configured to accommodate at least a load side heat exchanger of the refrigeration cycle, the load side heat exchanger being configured to allow heat exchange between the combustible refrigerant and a liquid heat medium, and the load unit including a fan, an air inlet to suck in air from the room, and an air outlet to blow out the air, sucked in from the air inlet, to the room, the air outlet being provided at a position of a height different from a height of the air inlet.

Advantageous Effects of Invention

According to an embodiment of the present invention, as it is possible to form an air flow circulating in the vertical direction in a room, and formation of a combustible concentration region can be suppressed even if combustible refrigerant is leaked.

DESCRIPTION OF EMBODIMENTS

Embodiment 1

Figure 1:
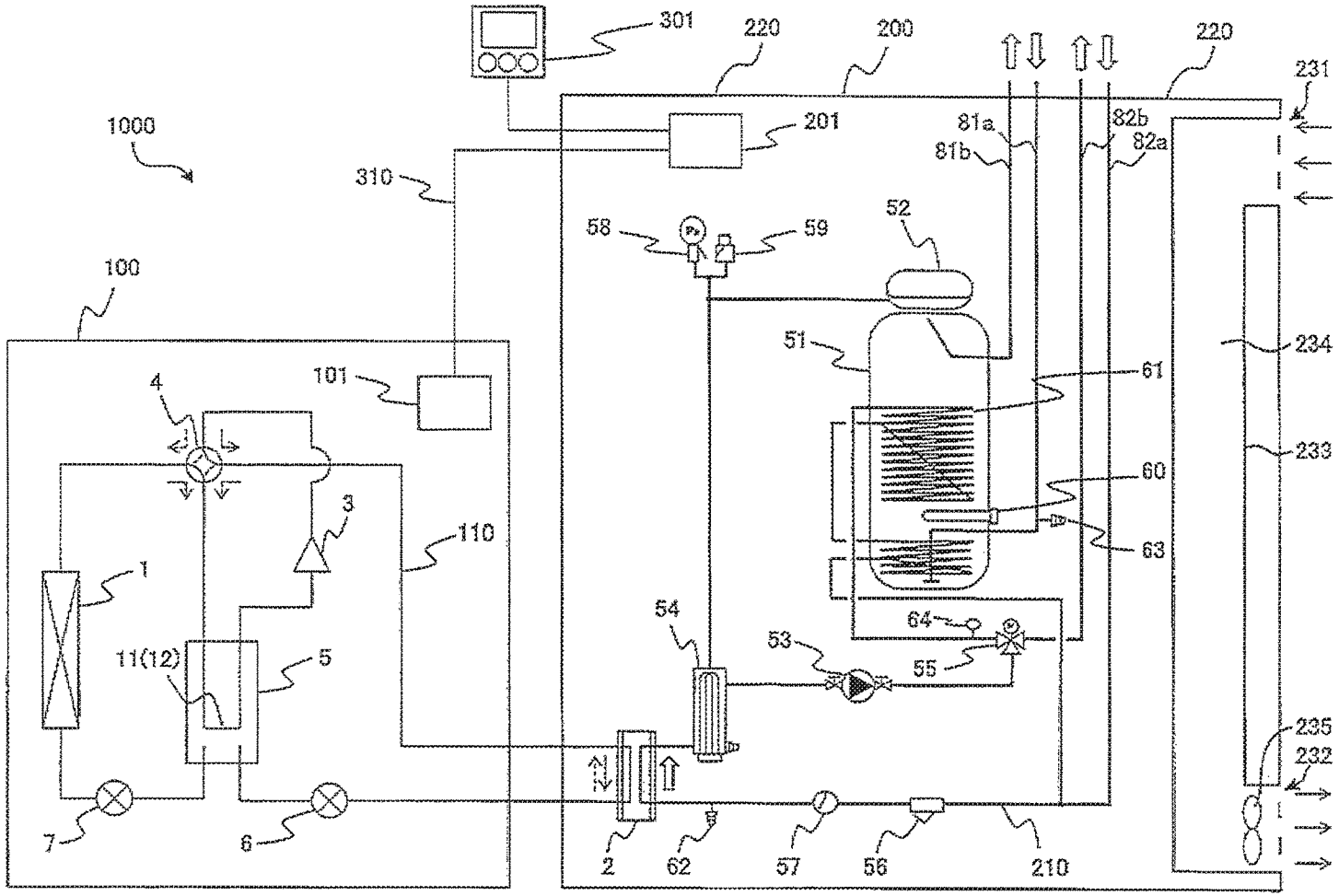
FIG. 1 is a diagram illustrating a schematic configuration of a heat pump apparatus according to Embodiment 1 of the present invention.

A heat pump apparatus according to Embodiment 1 of the present invention will be described. FIG. 1 is a diagram illustrating a schematic configuration of a heat pump apparatus of the present embodiment. In the present embodiment, a heat-pump water heater 1000 is illustrated as an example of a heat pump apparatus. In the drawings described below including FIG. 1, the size relationships, shapes, and the like of the respective constituent members may differ from the actual ones. Further, in principle, the positional relationship (vertical relationship, for example) between the respective constituent members in the description is that in the case where the heat pump apparatus is installed in a usable state.

As shown in FIG. 1, the heat-pump water heater 1000 includes a refrigerant circuit 110 (refrigeration cycle) for circulating refrigerant, and a water circuit 210 allowing the water (an example of liquid heat medium) to flow therein. First, the refrigerant circuit 110 will be described. The refrigerant circuit 110 is configured such that a compressor 3, a refrigerant flow path switching device 4, a load side heat exchanger 2 (indoor heat exchanger), a first expansion device 6, a medium-pressure receiver 5, a second expansion device 7, and a heat source side heat exchanger 1 (outdoor heat exchanger) are annularly connected sequentially via refrigerant pipes. In the heat-pump water heater 1000, normal operation (room heating and water heating operation) in which water flowing in the water circuit 210, described below, is heated, and defrosting operation in which refrigerant is made to flow in a direction opposite to that in the normal operation to defrost the heat source side heat exchanger 1, can be performed. The heat-pump water heater 1000 also includes a load unit 200 (indoor unit) installed in a room, and a heat source unit 100 (outdoor unit) installed outside the room, for example. The load unit 200 may be installed in a kitchen, a bathroom, a laundry room, or a storage space such as a storeroom in a building, for example.

As refrigerant circulating the refrigerant circuit 110, slightly combustible refrigerant such as R32, HFO-1234yf, or HFO-1234ze, or highly combustible refrigerant such as R290 or R1270 is used. These kinds of refrigerant may be used as single refrigerant or as mixed refrigerant in which two or more kinds are mixed.

The compressor 3 is fluid machinery configured to compress sucked-in low-pressure refrigerant and discharge it as high-pressure refrigerant. The compressor 3 of this example includes an inverter device or the like, and is able to change the capacity (the amount of feeding refrigerant per unit time) by changing the driving frequency arbitrarily.

The refrigerant flow path switching device 4 switches the flow direction of refrigerant in the refrigerant circuit 110 between the time of normal operation and the time of defrosting operation. As the refrigerant flow path switching device 4, a four-way valve is used, for example.

The load side heat exchanger 2 is a refrigerant-water heat exchanger allowing heat exchange between the refrigerant flowing in the refrigerant circuit 110 and the water flowing in the water circuit 210. The load side heat exchanger 2 serves as a condenser (radiator) for heating the water at the time of normal operation, and serves as an evaporator (heat absorber) at the time of defrosting operation.

The first expansion device 6 adjusts the flow rate of the refrigerant, and, for example, performs pressure adjustment (decompression) of the refrigerant flowing in the load side heat exchanger 2. The medium-pressure receiver 5 is located between the first expansion device 6 and the second expansion device 7 in the refrigerant circuit 110, and is used for storing extra refrigerant. Inside the medium-pressure receiver 5, a suction pipe 11, connected with the suction side of the compressor 3, runs through. In the medium-pressure receiver 5, heat is exchanged between the refrigerant passing through a through portion 12 of the suction pipe 11 and the refrigerant in the medium-pressure receiver 5. As such, the medium-pressure receiver 5 serves as an inner heat exchanger in the refrigerant circuit 110. The second expansion device 7 adjusts the flow rate of refrigerant and performs pressure adjustment. It is assumed that the first expansion device 6 and the second expansion device 7 of this example are electronic expansion valves capable of changing the opening degree thereof based on an instruction from a controller 101 described below.

The heat source side heat exchanger 1 is a refrigerant-air heat exchanger allowing heat exchange between the refrigerant flowing in the refrigerant circuit 110 and the air (outside air) conveyed by an outdoor fan (not shown). The heat source side heat exchanger 1 functions as an evaporator (heat absorber) at the time of normal operation, while functions as a condenser (radiator) at the time of defrosting operation.

The compressor 3, the refrigerant flow path switching device 4, the first expansion device 6, the medium-pressure receiver 5, the second expansion device 7, and the heat source side heat exchanger 1 are accommodated in the heat source unit 100. The load side heat exchanger 2 is accommodated in the load unit 200.

The heat source unit 100 is provided with a controller 101 that mainly controls operation of the refrigerant circuit 110 (for example, the compressor 3, the refrigerant flow path switching device 4, the first expansion device 6, the second expansion device 7, an outdoor fan not shown, and other devices). The controller 101 includes a microcomputer having a CPU, a ROM, a RAM, an I/O port, and other components. The controller 101 is configured to be able to perform data communications with a controller 201 and an operation unit 301, described below, via a control line 310.

Next, operation of the refrigerant circuit 110 will be described. In FIG. 1, a flow direction of the refrigerant in the refrigerant circuit 110 at the time of normal operation is indicated by solid line arrows. The refrigerant circuit 110 is configured such that at the time of normal operation, the refrigerant flow path is switched to that indicated by the solid lines by the refrigerant flow path switching device 4, and high-temperature and high-pressure refrigerant flows to the load side heat exchanger 2.

The high-temperature and high-pressure gas refrigerant, discharged from the compressor 3, first flows into the refrigerant flow path of the load side heat exchanger 2 via the refrigerant flow path switching device 4. At the time of normal operation, the load side heat exchanger 2 functions as a condenser. This means that in the load side heat exchanger 2, heat is exchanged between the refrigerant flowing in the refrigerant flow path and the water flowing in the water flow path of the load side heat exchanger 2, and the condensation heat of the refrigerant is radiated to the water. Thereby, the refrigerant flowing in the load side heat exchanger 2 is condensed to be high-pressure liquid refrigerant. Further, the water flowing in the water flow path of the load side heat exchanger 2 is heated by the heat radiated from the refrigerant.

The high-pressure liquid refrigerant, condensed in the load side heat exchanger 2, flows into the first expansion device 6, and is slightly decompressed to be two-phase refrigerant. The two-phase refrigerant flows into the medium-pressure receiver 5, and is cooled by heat exchange with the low-pressure gas refrigerant flowing in the suction pipe 11 to become liquid refrigerant. The liquid refrigerant flows into the second expansion device 7, and is decompressed to be low-pressure two-phase refrigerant. The low-pressure two-phase refrigerant flows into the heat source side heat exchanger 1. At the time of normal operation, the heat source side heat exchanger 1 functions as an evaporator. As such, in the heat source side heat exchanger 1, heat is exchanged between the refrigerant flowing inside and the air (outside air) delivered by the outdoor fan, and the evaporation heat of the refrigerant is absorbed from the sent air. Thereby, the refrigerant flowing in the heat source side heat exchanger 1 is vaporized to be low-pressure gas refrigerant. The low-pressure gas refrigerant flows into the suction pipe 11 via the refrigerant flow path switching device 4. The low-pressure gas refrigerant, flowing in the suction pipe 11, is heated by heat exchange with the refrigerant in the medium-pressure receiver 5, and is sucked into the compressor 3. The refrigerant sucked into the compressor 3 is compressed to be high-temperature and high-pressure gas refrigerant. The above-described cycle is repeated in the normal operation.

Next, operation at the time of defrosting operation will be described. In FIG. 1, a flow direction of refrigerant in the refrigerant circuit 110 at the time of defrosting operation is indicated by broken line arrows. The refrigerant circuit 110 is configured such that at the time of defrosting operation, the flow path of the refrigerant is switched by the refrigerant flow path switching device 4 as indicated by the broken lines, and high-temperature and high-pressure refrigerant flows to the heat source side heat exchanger 1.

The high-temperature and high-pressure gas refrigerant discharged from the compressor 3 flows into the heat source side heat exchanger 1 via the refrigerant flow path switching device 4. At the time of defrosting operation, the heat source side heat exchanger 1 functions as a condenser. As such, at the heat source side heat exchanger 1, heat is exchanged between the refrigerant flowing inside and the frost deposited on the surface of the heat source side heat exchanger 1. Thereby, the frost deposited on the surface of the heat source side heat exchanger 1 is heated by the condensation heat of the refrigerant and melts.

Next, the water circuit 210 will be described. The water circuit 210 is configured to include a hot water storage tank 51, the load side heat exchanger 2, a pump 53, a booster heater 54, a three-way valve 55, a strainer 56, a flow switch 57, a pressure relief valve 58, an air purge valve 59, and other components that are connected via water pipes. On the way of the pipes constituting the water circuit 210, a drain port 62 for draining the water in the water circuit 210 is provided. The water circuit 210 is accommodated in a casing 220 of the load unit 200.

The hot water storage tank 51 is a device for storing water therein. The hot water storage tank 51 incorporates a coil 61 connected with the water circuit 210. The coil 61 allows heat exchange between the water (hot water) circulating the water circuit 210 and water stored in the hot water storage tank 51 to heat the water stored in the hot water storage tank 51. The hot water storage tank 51 also incorporates an in-water heater 60. The in-water heater 60 is a heating unit for further heating the water stored in the hot water storage tank 51.

The water in the hot water storage tank 51 flows to a sanitary circuit side pipe 81*b* connected with a shower or the like, for example. Further, a sanitary circuit side pipe 81*a* also has a drain port 63. In this example, the hot water storage tank 51 is covered by a heat insulating material (not shown) to prevent the water stored in the hot water storage tank 51 from being cooled by the outside air. As the heat insulating material, felt, Thinsulate (registered trademark), a vacuum insulation panel (VIP), or other materials may be used.

The pump 53 is a device for applying pressure to the water in the water circuit 210 to circulate it in the water circuit 210. The booster heater 54 is a device for further heating the water in the water circuit 210 when the heating capacity of the heat source unit 100 is insufficient. The three-way valve 55 is a device for allowing the water in the water circuit 210 to branch. For example, the three-way valve 55 performs switching to allow the water in the water circuit 210 to flow to the hot water storage tank 51 side, or flow to a heating circuit side pipe 82*b* to which a radiator provided outside, a radiator of floor heating, or other appliances are connected. In this example, the heating circuit side pipes 82*a* and 82*b* are pipes for circulating the water with the heater. The strainer 56 is a device for removing scale (deposits) in the water circuit 210. The flow switch 57 is a device for detecting whether or not the flow rate circuiting in the water circuit 210 is a certain amount or more.

An expansion tank 52 is a device for controlling the pressure varying according to a capacitance change of the water in the water circuit 210 due to heating or the like, within a certain range. When the pressure in the water circuit 210 increases beyond the pressure control range of the expansion tank 52, the water in the water circuit 210 is released to the outside by the pressure relief valve 58.

The pressure relief valve 58 is a protective device. The air purge valve 59 is a device for releasing the air generated in the water circuit 210 to the outside to prevent idling (air entrainment) of the pump 53. A manual air purge valve 64 is a hand-operated valve for releasing air from the water circuit 210. The manual air purge valve 64 is used for releasing air mixed into the water circuit 210 at the time of water-filling work of installation construction, for example.

The load unit 200 is provided with a controller 201 configured to mainly control operation of the water circuit 210 (the pump 53, the booster heater 54, the three-way valve 55, and other devices, for example). The controller 201 includes a microcomputer having a CPU, a ROM, a RAM, an I/O port, and the like. The controller 201 is configured to be able to perform data communications with the controller 101 and the operation unit 301.

The operation unit 301 is configured to allow a user to perform operation and various types of setting of the heat-pump water heater 1000. The operation unit 301 of this example includes a display device on which various types of information such as a state of the heat-pump water heater 1000 can be displayed. The operation unit 301 is provided on the front surface of the casing 220 of the load unit 200, at a position of a height (about 1 to 1.5 m from the floor, for example) where a user is able to operate it by hand, for example (see FIG. 2).

Figure 2:
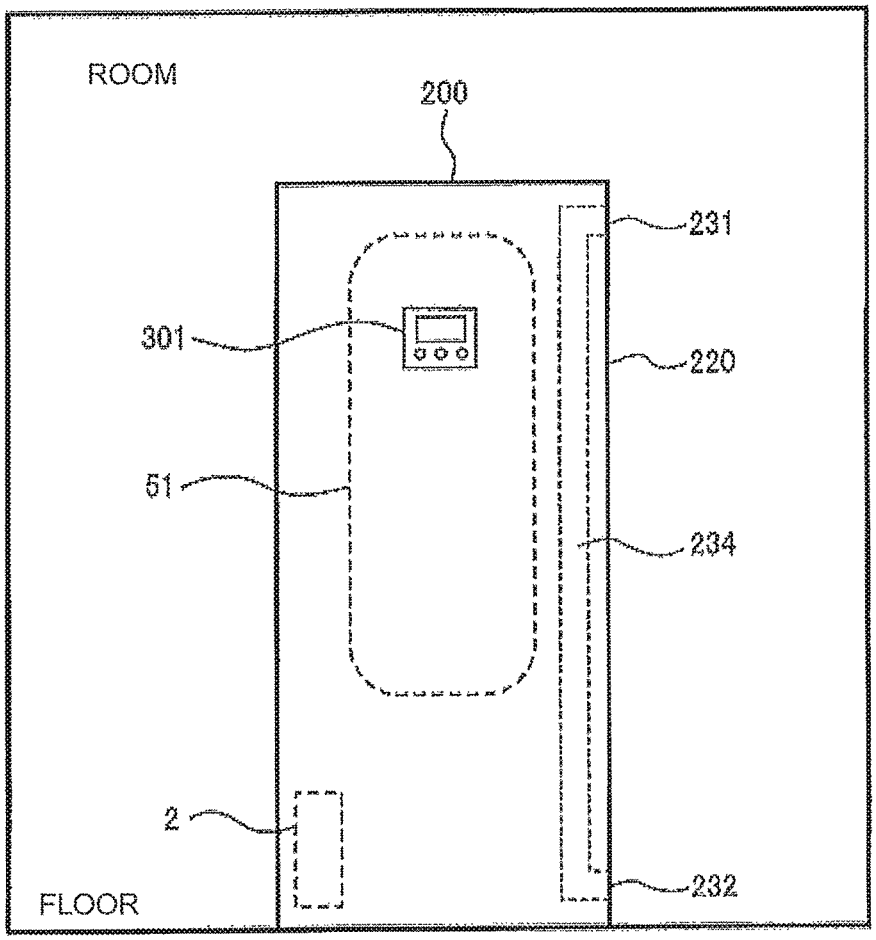
FIG. 2 is a front view illustrating a configuration of a load unit 200 of the heat pump apparatus according to Embodiment 1 of the present invention.
Figure 3:
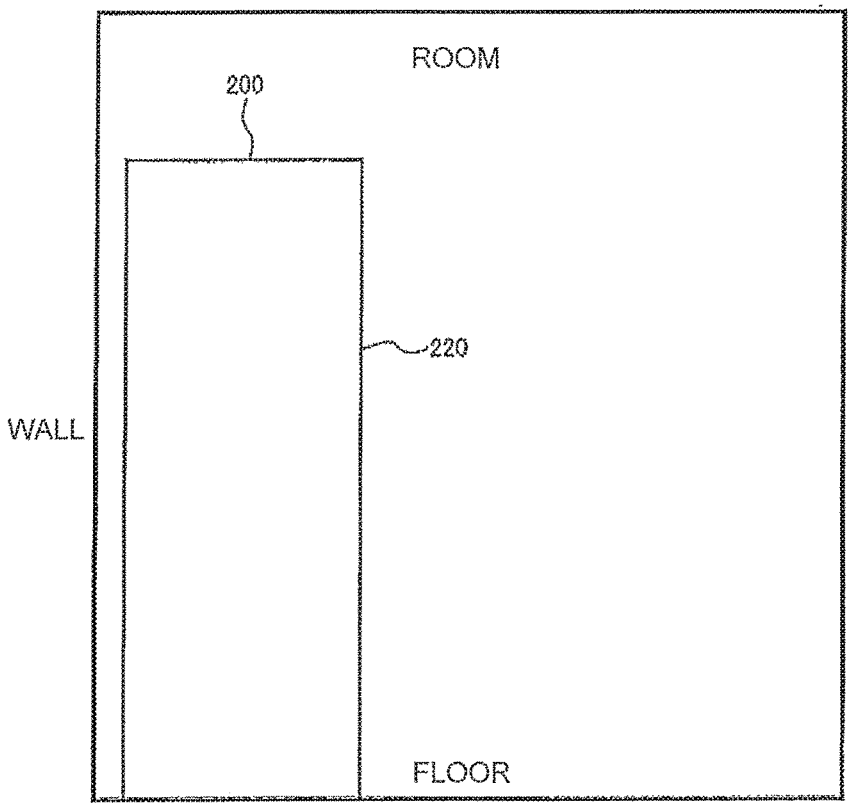
FIG. 3 is a side view illustrating the configuration of the load unit 200 of the heat pump apparatus according to Embodiment 1 of the present invention.

The structural features of the load unit 200 will be described using FIGS. 2 and 3, in addition to FIG. 1. FIG. 2 is a front view illustrating the configuration of the load unit 200. FIG. 3 is a side view (left side view) illustrating the configuration of the load unit 200. In FIGS. 2 and 3, a schematic installation state of the load unit 200 in a room is also illustrated. As shown in FIGS. 1 to 3, the load unit 200 incorporates the hot water storage tank 51 of floor type for installation on the floor in a room. The load unit 200 is provided with the casing 220 in a vertically long rectangular parallelepiped shape. The load unit 200 is installed such that a predetermined space is formed between the rear surface of the casing 220 and a wall of the room, for example. The casing 220 is made of metal, for example.

In the casing 220, an air inlet 231 for sucking in air from the room and an air outlet 232 for blowing off the air sucked in from the air inlet 231 are formed. The air inlet 231 is provided to an upper portion of a side surface (right side surface in this example) of the casing 220. The air inlet 231 of this example is provided at a position higher than the height of the operation unit 301. The air outlet 232 is provided in a lower portion of a side surface (right side surface in this example) of the casing 220, that is, at a position lower than the height of the air inlet 231. The air outlet 232 of this example is provided at a position lower than the height of the operation unit 301, which is close to the floor in the room.

It should be noted that the air inlet 231 may be provided on the top surface, the front surface, the left side surface, or the rear surface as long as it is in an upper portion of the casing 220. The air outlet 232 may be provided on the front surface, the left side surface, or the rear surface if it is in a lower portion of the casing 220. Further, a vertical relationship between the position of the air inlet 231 and the position of the air outlet 232 may be opposite. This means that the air outlet 232 may be provided at a position higher than the height position of the air inlet 231.

In the casing 220, the air inlet 231 and the air outlet 232 are connected by a duct 233 extending in the almost vertical direction. The duct 233 is made of metal, for example. In the space in the duct 233, an air passage 234, through which the air passes, is formed between the air inlet 231 and the air outlet 232. The air passage 234 is isolated from high-temperature components such as the load side heat exchanger 2 and the hot water storage tank 51, and from a space in the casing 220 in which electronic components and the like are accommodated, by the duct 233. However, in the casing 220, the duct 233 may not be provided if a flow path of the air (air passage 234) can be formed between the air inlet 231 and the air outlet 232.

The air passage 234 is provided with a fan 235 generating an air flow flowing from the air inlet 231 to the air outlet 232 in the air passage 234. As the fan 235, a cross flow fan, a turbo fan, a sirocco fan, a propeller fan, or another fan may be used. The fan 235 is installed facing the air outlet 232, for example. The fan 235 of this example is configured to operate at all times when the power is supplied, including the time when the refrigeration cycle is stopped (when the compressor 3 is stopped, for example). As such, the fan 235 is activated when power supply to the load unit 200 (or the fan 235 itself) is started (for example, when the load unit 200 is connected to the power source via a power source cord or the like) irrespective of control by the controller 201, and continues operation until the power supply is interrupted. Alternatively, in the case where operation of the fan 235 is controlled by the controller 201, the controller 201 activates the fan 235 without waiting for an operation of the operation unit 301 by the user, when power supply to the load unit 200 is started, and causes the fan 235 to continue operation until the power supply is interrupted. Further, the controller 201 may monitor the operating state of the fan 235 regardless of whether or not to control operation of the fan 235. In this case, when the controller 201 detects stop of the fan 235, the controller 201 may inform the user of abnormality using a display device, a speaker, or other means of the operation unit 301. Further, the fan 235 may be configured to perform intermittent operation in a constant cycle, for example.

As the air inlet 231 and the air outlet 232 are provided at positions of different heights, it is possible to always generate an air flow circulating at least in the vertical direction (height direction) in the room where the load unit 200 is installed.

As described above, in the present embodiment, combustible refrigerant such as R32, HFO-1234yf, HFO-1234ze, R290, or R1270 is used as refrigerant circulating in the refrigerant circuit 110. Therefore, if leakage of refrigerant occurs in the load unit 200, refrigerant concentration in the room may increase to form a combustible concentration region.

Such combustible refrigerants have a density higher than that of the air under the atmospheric pressure. Therefore, when leakage of refrigerant occurs at a relatively high position from the floor in the room, the leaked refrigerant is diffused during lowering and the refrigerant concentration is made uniform in the room, so that the refrigerant concentration is less likely to increase. On the other hand, when leakage of refrigerant occurs at a low position from the floor in the room, the leaked refrigerant stays at a low position near the floor, so that the refrigerant concentration is likely to be high locally. Thereby, a possibility that a combustible concentration region is formed increases relatively.

In the present embodiment, as an air flow circulating in the vertical direction in the room can be generated at all times, the air in the room can be stirred in the vertical direction. Therefore, if leakage of combustible refrigerant occurs in the load unit 200, the air at a lower position where the refrigerant concentration is likely to increase and the air at a high position where the refrigerant concentration is less likely to increase can be mixed easily. As such, according to the present embodiment, it is possible to prevent leaked combustible refrigerant from staying at a low position near the floor to suppress formation of a combustible concentration region. In particular, in the case of the floor type load unit 200, a position where leakage of refrigerant may occur is likely to be a low position near the floor, and leaked refrigerant is likely to stay at a low position near the floor. As such, a particularly high effect can be achieved.

Further, in the present embodiment, it is possible to suppress formation of a combustible concentration region without using a refrigerant leakage sensor for detecting leakage of refrigerant. As such, according to the present embodiment, as there is no need to replace a refrigerant leakage sensor in the standard use period of the load unit 200 or the heat pump apparatus (heat-pump water heater 1000), the maintenance cost can be suppressed and the reliability of the heat pump apparatus can be further enhanced.

Further, according to the present embodiment, the air passage 234 is isolated from the space for accommodating high-temperature components, electric components, and other components, by the duct 233. According to the present embodiment, even if the air containing combustible refrigerant flows in the air passage 234 it is possible to prevent the combustible refrigerant in the air passage 234 from being in contact with high-temperature components, electric components, and other components.

Figure 4:
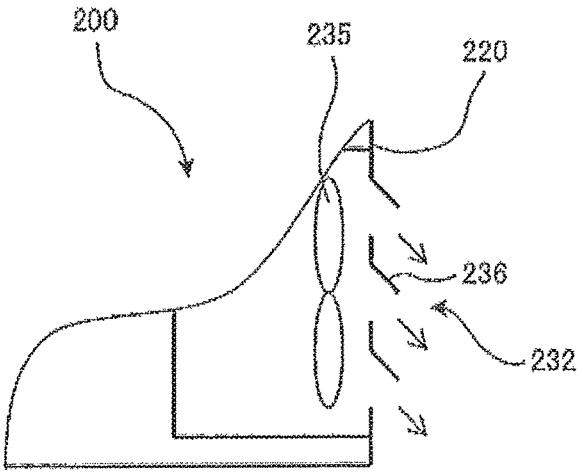
FIG. 4 is a partial sectional view illustrating a configuration of the load unit 200 according to a modification of Embodiment 1 of the present invention.

FIG. 4 is a sectional view illustrating a configuration of the load unit 200 according to a modification of the present embodiment. FIG. 4 illustrates a configuration near the air outlet 232. As illustrated in FIG. 4, in the present modification, the air outlet 232 is formed in a lower portion of a side surface (or lower portion of a front surface, or a lower portion of a rear surface) of the casing 220. The air outlet 232 is provided with airflow direction louvers 236 directed downward (diagonally downward, for example). Thereby, as the wind direction of the air blown off from the air outlet 232 can be directed downward, refrigerant that is likely to stay at a low position near the floor can be effectively caused to diffuse.

Figure 5:
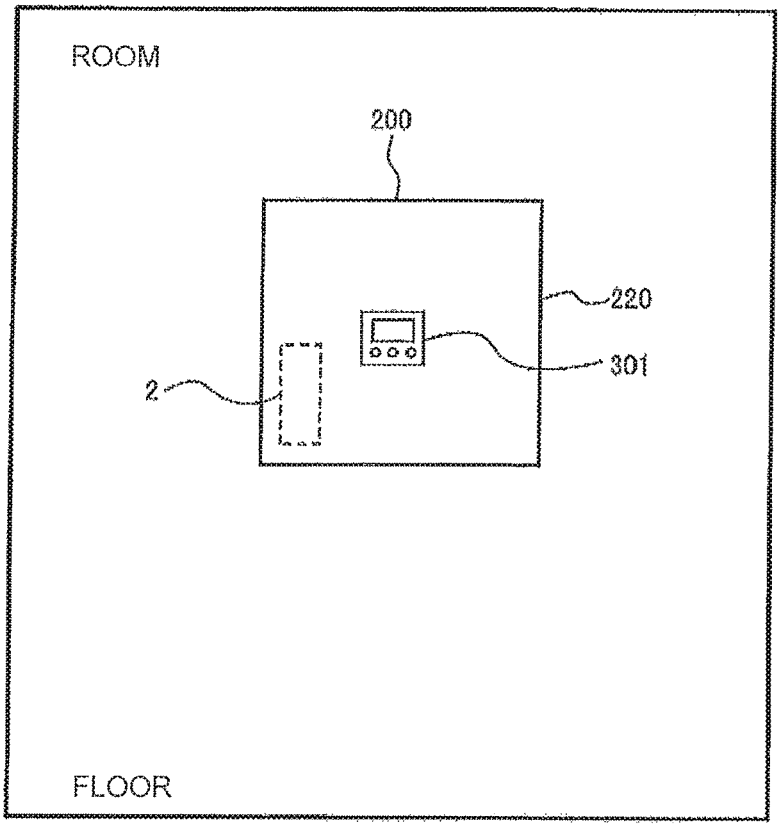
FIG. 5 is a front view illustrating a configuration of the load unit 200 according to another modification of Embodiment 1 of the present invention.
Figure 6:
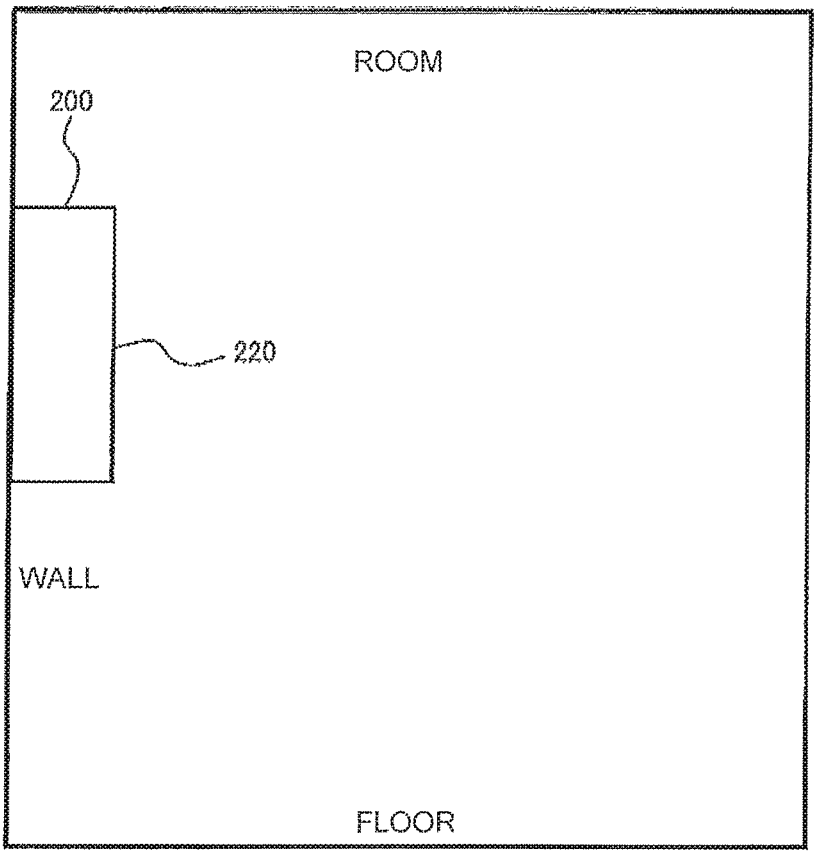
FIG. 6 is a side view illustrating the configuration of the load unit 200 according to another modification of Embodiment 1 of the present invention.
Figure 7:
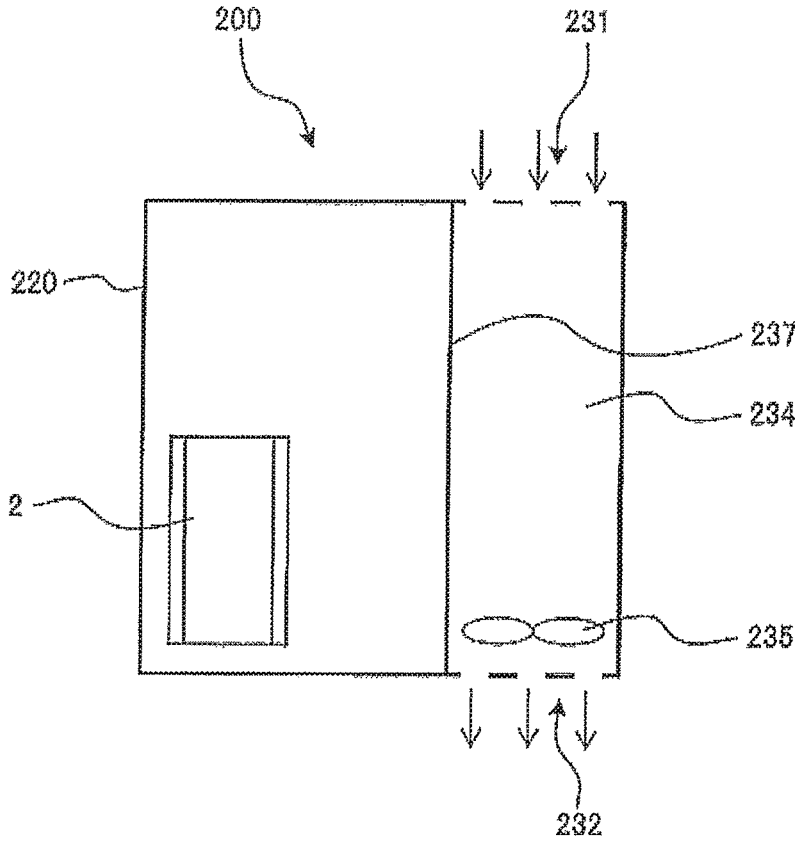
FIG. 7 is a front view illustrating an internal configuration of the load unit 200 according to another modification of Embodiment 1 of the present invention.

FIG. 5 is a front view of a configuration of the load unit 200 according to another modification of the present embodiment. FIG. 6 is a side view (left side view) illustrating a configuration of this load unit 200. FIG. 7 is a front view illustrating an inner configuration of this load unit 200. As illustrated in FIGS. 5 to 7, the load unit 200 of the present modification is that of wall mounted type not incorporating a hot water storage tank. The load unit 200 is fixed to a wall in a room, and is installed at a position higher than the floor of the room. The casing 220 of the load unit 200 accommodates at least the load side heat exchanger 2. A hot water storage tank is independent of the load unit 200 and is disposed at a different location.

The casing 220 has the operation unit 301 provided on the front surface. The operation unit 301 is provided at a position of a height (about 1 to 1.5 m from the floor, for example) where a user can operate it by hand.

The air inlet 231 is formed on the top surface of the casing 220, and the air outlet 232 is formed on the bottom surface of the casing 220. The air passage 234 between the air inlet 231 and the air outlet 232 is isolated from a space in the casing 220 for accommodating high-temperature components, electric components, and other components such as the load side heat exchanger 2, by a partition plate 237. The partition plate 237 is made of metal, for example.

While the load unit 200 of the present modification is of wall mounted type, as the operation unit 301 is disposed at a height where a user is able to operate by hand, it is installed at a height lower than that of a wall mounted type indoor unit of an air-conditioning apparatus. As such, in the case of the load unit 200 of such wall mounted type, the position where leakage of refrigerant may occur is likely to be a low position near the floor, and leaked refrigerant is likely to stay at a low position near the floor. Accordingly, a high effect, similar to the case of the floor type load unit 200, can be achieved.

As described above, the heat pump apparatus, according to the embodiment described above, is a heat pump apparatus including a refrigeration cycle (refrigerant circuit 110) for circulating combustible refrigerant, and the load unit 200 configured to accommodate at least the load side heat exchanger 2 of the refrigeration cycle and disposed in a room. The load side heat exchanger 2 allows heat exchange between combustible refrigerant and liquid heat medium (water, for example). The load unit 200 includes the casing 220 accommodating the load side heat exchanger 2, the air inlet 231, provided to the casing 220, for sucking in air from the room, the air outlet 232, provided at a position of a height different from the height of the air inlet 231 (position of a lower height than that of the air inlet 231, for example) on the casing 220, for blowing out the air sucked in from the air inlet 231 to the room, and the fan 235 for generating an air flow from the air inlet 231 to the air outlet 232 in the casing 220 and causing an air flow to circulate at least in the vertical direction in the room.

Further, in the heat pump apparatus according to the present embodiment, the fan 235 may be configured to operate at all times including the time when the refrigeration cycle (compressor 3, for example) is not operating.

Further, in the heat pump apparatus according to the embodiment described above, the load unit 200 may further include the air passage 234 formed between the air inlet 231 and the air outlet 232 in the casing 220, and the air passage 234 may be isolated from the space where the load side heat exchanger 2 is accommodated.

Further, in the heat pump apparatus according to the embodiment described above, the load unit 200 may be of floor type for installation on the floor in the room, and one of the air inlet 231 and the air outlet 232 may be provided on an upper portion of the front surface, an upper portion of a side surface, an upper portion of the rear surface, or the top surface of the casing 220, and the other of the air inlet 231 and the air outlet 232 may be provided on a lower portion of the front surface, a lower portion of a side surface, or a lower portion of the rear surface of the casing 220.

Further, in the heat pump apparatus according to the embodiment described above, the load unit 200 may be of wall mounted type for installation at a position higher than the floor of the room, and one of the air inlet 231 and the air outlet 232 may be provided on an upper portion of the front surface, an upper portion of a side surface, or the top surface of the casing 220, and the other of the air inlet 231 and the air outlet 232 may be provided on a lower portion of the front surface, a lower portion of a side surface, or the bottom surface of the casing 220.

Further, in the heat pump apparatus according to the embodiment described above, the air outlet 232 may be provided on a lower portion of the front surface, a lower portion of a side surface, or a lower portion of the rear surface of the casing 220, and the air outlet 232 may be provided with the airflow direction louver 236 directed downward.

Other Embodiments

The present invention can be modified in various ways without being limited to the embodiment described above.

For example, while the heat-pump water heater 1000 is exemplarily described as a heat pump apparatus in the embodiment described above, the present invention is applicable to other heat pump apparatuses other than the heat-pump water heater 1000. Further, while water is exemplarily described as a liquid heat medium in the embodiment described above, in the case of a heat pump apparatus for use other than water heating (only heating or cooling of a room, for example), another liquid heat medium such as brine may be used.

Further, in the embodiment described above, the heat pump apparatus (inside the casing 220 of the load unit 200, for example) may be provided with a battery, an uninterruptible power supply device, or other devices capable of supplying electrical power to the fan 235. Thereby, the fan 235 is operable even at the time of power failure. As such, formation of a combustible concentration region can be suppressed more reliably when leakage of combustible refrigerant occurs.

Further, the embodiments and modifications described above may be carried out by being combined with each other.

REFERENCE SIGNS LIST

1 heat source side heat exchanger 2 load side heat exchanger 3 compressor 4 refrigerant flow path switching device 5 medium-pressure receiver 6 first expansion device 7 second expansion device 11 suction pipe 12 through portion 51 hot water storage tank 52 expansion tank 53 pump 54 booster heater 55 three-way valve 56 strainer 57 flow switch 58 pressure relief valve 59 air purge valve 60 in-water heater 61 coil 62, 63 drain port 64 manual air purge valve 81*a*, 81*b* sanitary circuit side pipe 82*a*, 82*b* heating circuit side pipe 100 heat source unit 101, 201 controller 110 refrigerant circuit 200 load unit 210 water circuit 220 casing 231 air inlet 232 air outlet 233 duct 234 air passage 235 fan 236 airflow direction louver 237 partition plate 301 operation unit 310 control line 1000 heat-pump water heater

The invention claimed is:

1. A heat pump apparatus comprising:

a refrigeration cycle configured to circulate combustible refrigerant; and a load unit disposed in a room, the load unit being configured to accommodate at least a load side heat exchanger of the refrigeration cycle, wherein the load side heat exchanger is configured to allow heat exchange between the combustible refrigerant and a liquid heat medium, and the load unit includes a fan, an air inlet to suck in air from the room, an air outlet to blow out the air, sucked in from the air inlet, to the room, a duct, which extends in a vertical direction, provided between the air inlet and the air outlet; and an air passage that connects the air outlet with the air inlet so that the fan generates an air flow from the inlet to the outlet through the air passage, the air passage is formed inside the duct, the fan is located inside the duct, the air outlet is provided at a position of a height different from a height of the air inlet, the air passage is isolated from a space for accommodating the load side heat exchanger, and the air flow from the air inlet to the air outlet causes an air flow to circulate in a vertical direction in the room.

2. The heat pump apparatus of claim 1, wherein the fan is configured to operate at all times including a time when the refrigeration cycle is not operating.

3. The heat pump apparatus of claim 1, wherein the load unit is of floor type for installation on a floor of the room, one of the air inlet and the air outlet is provided on an upper portion of a front surface, an upper portion of a side surface, an upper portion of a rear surface, or a top surface, of a casing of the load unit, and another of the air inlet and the air outlet is provided in a lower portion of the front surface, a lower portion of a side surface, or a lower portion of the rear surface, of the casing.

4. The heat pump apparatus of claim 1, wherein the load unit is of wall mounted type for installation at a position higher than a height of a floor of the room, one of the air inlet and the air outlet is provided on an upper portion of a front surface, an upper portion of a side surface, or a top surface of a casing of the load unit, and another of the air inlet and the air outlet is provided in a lower portion of the front surface, a lower portion of a side surface, or a bottom surface, of the casing.

5. The heat pump apparatus of claim 1, wherein the air outlet is provided on a lower portion of a front surface, a lower portion of a side surface, or a lower portion of a rear surface, of a casing of the load unit, and the air outlet is provided with an airflow direction louver directed downward.

* * * * *